United States Patent [19]

Knowles

[11] 4,308,703

[45] Jan. 5, 1982

[54] METAL CONNECTOR STRUTS FOR TRUSS-TYPE BEAMS

[76] Inventor: James Knowles, 1275 Club Dr., Bloomfield Hills, Mich. 48013

[21] Appl. No.: 113,171

[22] Filed: Jan. 18, 1980

[51] Int. Cl.[3] ..... E04C 3/02

[52] U.S. Cl. ..... 52/694; 52/696; 52/DIG. 6; 411/461; 411/468

[58] Field of Search ..... 52/DIG. 6, 694, 695, 52/696, 693, 692, 691, 642; 85/13; 411/461, 468

[56] References Cited

U.S. PATENT DOCUMENTS

| | | | |
|---|---|---|---|
| 1,880,478 | 10/1932 | Ragsdale | 52/694 |
| 2,092,684 | 9/1937 | Uhl | 85/13 |
| 3,103,262 | 9/1963 | Handley | 52/693 |
| 3,242,620 | 3/1966 | Kaiser | 52/73 |
| 3,353,320 | 11/1967 | Grasis | 52/693 |
| 3,905,171 | 9/1975 | Cargill | 85/13 |
| 4,078,352 | 3/1978 | Knowles | 52/696 |
| 4,207,719 | 6/1980 | Knowles | 52/693 |

FOREIGN PATENT DOCUMENTS

| | | | |
|---|---|---|---|
| 1069272 | 8/1980 | Canada | 52/694 |
| 1199914 | 11/1959 | France | 52/693 |

*Primary Examiner*—Price C. Faw, Jr.

*Assistant Examiner*—Henry E. Raduazo

*Attorney, Agent, or Firm*—Cullen, Sloman, Cantor, Grauer, Scott & Rutherford

[57] ABSTRACT

A sheet metal web unit for interconnecting vertically spaced apart, horizontal wood chords, is formed as an elongated channel-shaped strut with integral, flat, connector plates on its upper and lower ends. The channel is curved and shallower at the lower end of the strut and gradually gets deeper and flatter towards the upper end. The width of the channel gradually decreases and the depth of the channel legs gradually increases from the lower end to the upper end of the strut. A W-shaped web unit is formed of four of such struts integrally connected together by common connector plates. The connector plates overlap vertical face portions of the wood chords and have struck-out teeth for embedding within those overlapped face portions. The ends of the channel leg portions which are closest to the connector plate teeth are extended to overlap and also embed into the adjacent chord face portion to thereby reduce the load on the tooth nearest to the respective strut end. The connector plates are formed with integral, flat, co-planar extension strips which vertically extend into the space between the chords and between the struts which are integral with that plate.

19 Claims, 13 Drawing Figures

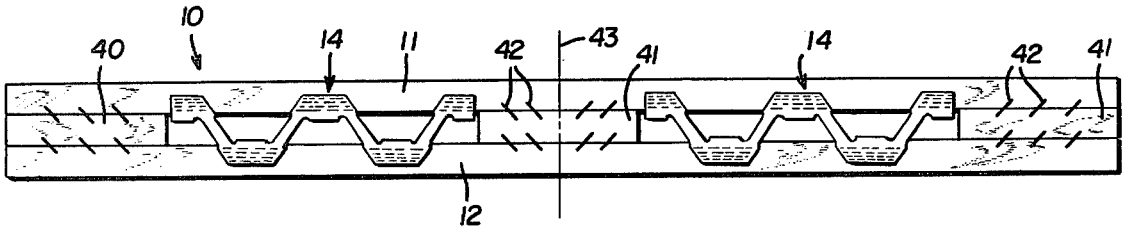
FIG. 1
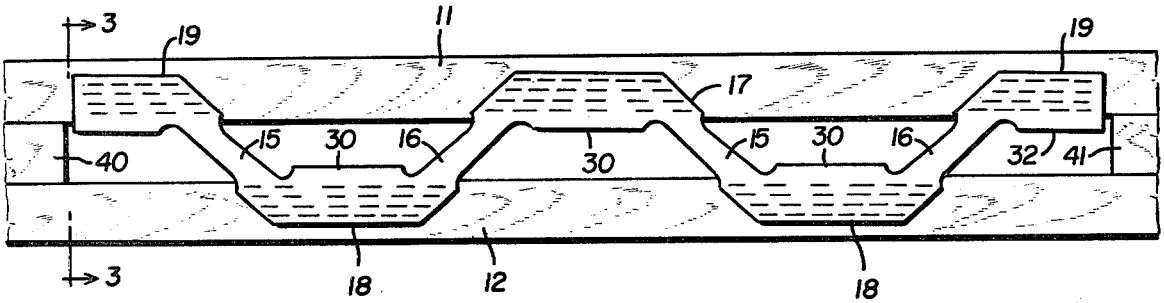
FIG. 2
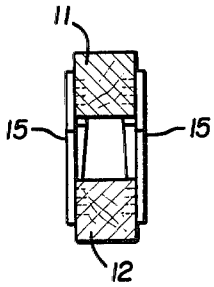
FIG. 3
FIG. 4
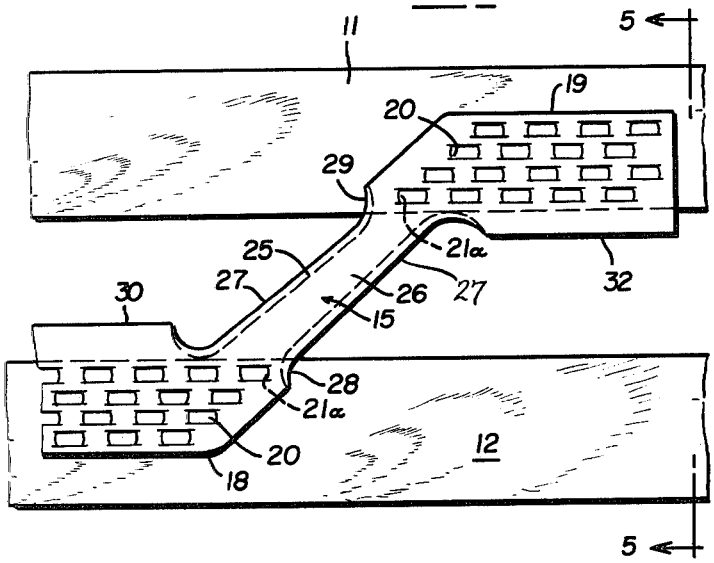
FIG. 5
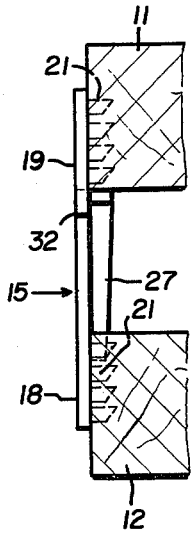

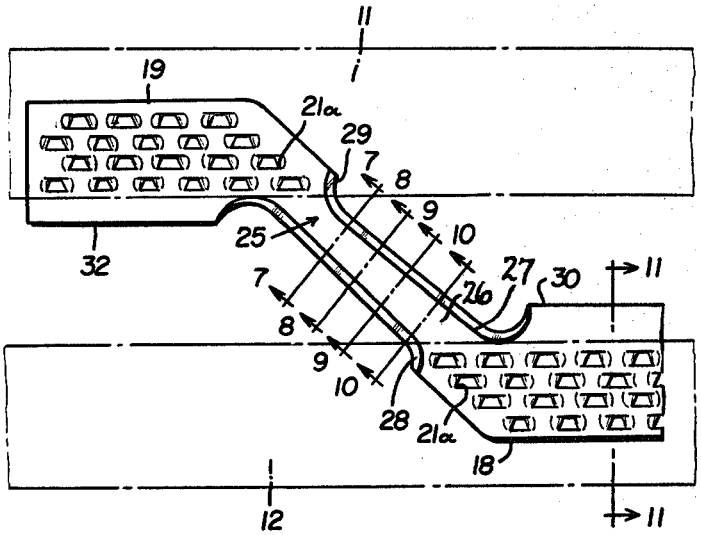
FIG. 6
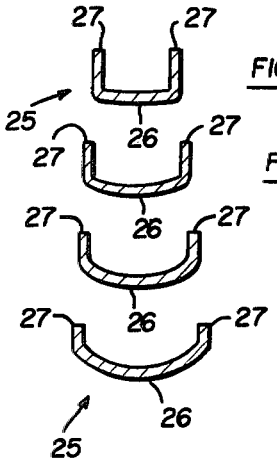
FIG. 7
FIG. 8
FIG. 9
FIG. 10
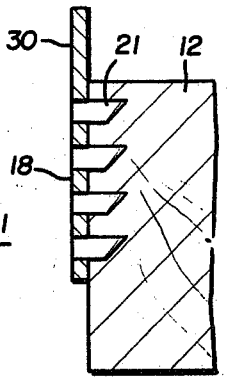
FIG. 11
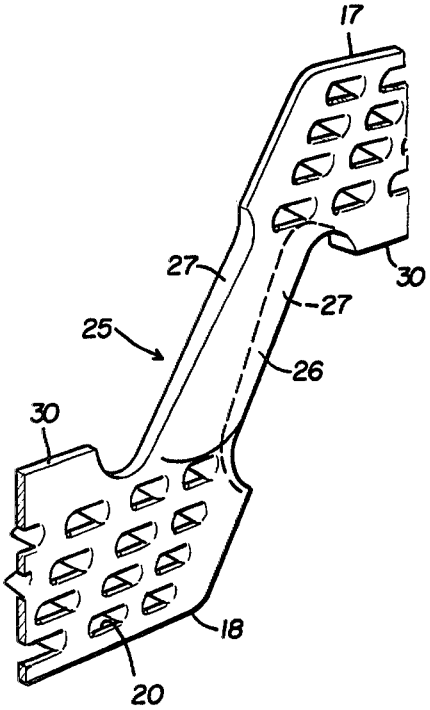
FIG. 12
FIG. 13
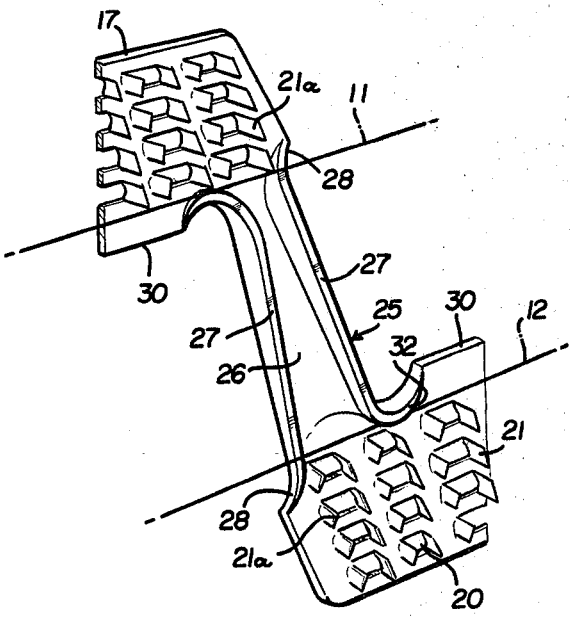

METAL CONNECTOR STRUTS FOR TRUSS-TYPE BEAMS

CROSS-REFERENCE TO RELATED APPLICATION

This application is related to another application of the same inventor which was filed concurrently with the filing of the present application and is entitled "Composite Wood Beam and Method of Making Same". The other application is further identified as Ser. No. 113,370 filed Jan. 18, 1980.

BACKGROUND OF INVENTION

In constructing dwelling houses and other small buildings, it is a common practice to use large wood beams as floor, ceiling or roof joists or supports. Generally such beams are formed of solid wood having nominal cross-sectional dimensions on the order of 2×6, 4×6, 4×8, 4×10 inches and the like. Ordinarily, said beams are rectangular in cross-section and are arranged with their height dimensions being greater than their width dimensions.

Because of increased demand, the availability of such type wood beams has decreased, and the prices have increased. Thus, the invention herein is concerned with fabricating a truss-like beam from an assembly of smaller cross-section, less expensive, wood chords interconnected with metal struts or webs.

In the past, fabricated trusses have been utilized in building constructions, particularly for roof supports. An example of such a truss, which utilizes parallel chords of wood, with interconnecting web units or struts, is illustrated in my U.S. Pat. No. 4,002,116 which was granted Jan. 11, 1977 for an "Apparatus for Forming Trusses" and also in my U.S. Pat. No. 4,078,352, granted Mar. 14, 1978 for a "Truss-Web Connector".

The fabricated truss construction of my above mentioned patents is a simplification of, and a considerable improvement over, prior fabricated trusses which are formed of wood chords and metal web units or struts and which, for example, are illustrated in various forms and styles in U.S. Pat. No. 3,025,577 to Jureit, issued Mar. 20, 1962, U.S. Pat. No. 3,416,283 to Sanford issued Dec. 17, 1968, U.S. Pat. No. 3,651,612 to Schmidt issued Mar. 28, 1972, U.S. Pat. No. 3,748,809 to Jackson, issued July 31, 1973 and Swiss Pat. No. 306,573 to Kampf, issued Apr. 30, 1955. The fabricated truss-type constructions of these prior patents have not been utilized in the past in sizes and shapes useful as, or economically feasible for use as, replacements for conventionally used wood beams. Although the fabricated truss of my above mentioned earlier U.S. Pat. No. 4,078,352 more readily may be used for larger beam sizes, the construction for beam use is relatively expensive. The fabricated trusses of the other mentioned patents, for all practical purposes, are too high to successfully compete with or serve as replacements for wood beams.

Consequently, more recently I have developed a truss-type beam construction which is disclosed in my U.S. patent application Ser. No. 893,317, filed Apr. 3, 1978, and identified as a "Composite Construction Beam". The fabricated truss-like beam of such application is economically feasible as a replacement for wood beams in competitive size ranges. However, it is desirable to still further reduce costs and to provide a structure with increased strength and, therefore, which will support greater loads. Thus, the invention of this present application relates to certain improvements in the struts or web units used in fabricating truss-like beams which increase beam stengths and allowable loads and permit reduced costs of fabrication, so as to make such beams even more competitive with solid wood beams.

SUMMARY OF INVENTION

The invention herein contemplates forming sheet metal web units useful for interconnecting parallel, vertically spaced apart, wood chords, such as 2×4's and the like. These web units are formed with struts which are channel shaped in cross section and having integrally formed connector plates at their upper and lower ends. These plates overlap the vertical face portions of the opposite wood chords and are fastened thereto by means of struck-out teeth which embed into the wood. The channels are arranged with their legs extending into the space between the chords so that the channel bases are approximately in the plane of the vertical faces of the chords. Such channels are tapered in three ways: first, the widths of the channels are narrowed going from bottom to top thereof; second, the depths (lengths) of the legs increase going from bottom to top of the struts; and third, the channel bases are curved at the bottoms of the struts, but gradually flatten out into a substantially flat upper end.

The tapered channel formation results in shifting inwardly the neutral axis of the strut which considerably reduces the force component, resulting from beam loading, that tends to push out the upper connector plate teeth from the wood. In other words, the inward shifting of the neutral axis of the strut considerably reduces the sidewise forces upon the connector plate teeth. Moreover, the co-action between the narrowing width and increasing channel leg depth, provides for considerable increased strength, which permits the use of thinner gauge sheet metal, less expensive grades of wood for the chords, and greater length joists or beams with reduced height requirements.

The invention herein also contemplates utilizing end portions of the channel legs to overlap and embed into adjacent portions of the chords for thereby absorbing part of the load normally imposed upon the first struck-out tooth of the connector plate. This reduces the tendency of said tooth, which is the most vulnerable, to pull out of the wood and consequently, permits greater loads to be carried by the beam.

In addition, the invention contemplates adding a flat, integral, strip-like extension on the common connector plate portions which form the apex of each intersecting pair of struts which make up a web unit. That is, oppositely angled struts are formed into integral V-shaped or W-shaped units. Thus, the strip extension is located between an adjacent pair of struts and extends into the space between the chords. This produces a considerable rigidification of the beam. It also provides a resistance against twist out or pull out of the connector plate teeth from the chord due to sidewise, torque type forces upon the connector plates. Therefore, the load carrying capacity of the beam is increased.

One objective of this invention is to provide an easily handleable web unit construction comprising groups of struts, preferably in a W-shaped configuration, of the type described in my above mentioned U.S. Patent Application Ser. No. 893,317, but with added strength and added resistance to tooth disengagement so as to provide a stronger, truss-like beam. Thus, it can be seen that a basic object of this invention is to provide the means for fabricating truss-like beam in sizes which are competitive to solid wood beams, at a reduced cost and increased strength and, particularly, making it possible to utilize lower grade, more readily available lumber.

These and other objects and advantages of this invention will become apparent upon reading the following description, of which the attached drawings form a part.

DESCRIPTION OF DRAWINGS

FIG. 1 is an elevational view of the truss-like beam.

FIG. 2 is an enlarged, elevational view of a portion of the beam.

FIG. 3 is a cross-sectional end view taken in the direction of arrows 3—3 of FIG. 2.

FIG. 4 is an enlarged, elevational view of a strut and its end connector plates and fragements of the wood chords.

FIG. 5 is an end view taken in the direction of arrows 5—5 of FIG. 4.

FIG. 6 is an elevational view, similar to FIG. 4, but showing an inside view of the strut and integral connector plates.

FIGS. 7, 8, 9 and 10 are cross sectional views taken in the direction of arrows 7—7, 8—8, 9—9 and 10—10, respectively, of FIG. 6 to illustrate the cross-sectional changes in the strut channel.

FIG. 11 is a cross-sectional view of the connector plate and adjacent wood chord, taken as if in the direction of arrows 11—11 of FIG. 6.

FIG. 12 is a perspective view of the outside of a strut and connector plate portions thereof, and FIG. 13 is an inside, perspective view of the strut and connector plate portions of FIG. 12.

DETAILED DESCRIPTION

Referring to FIG. 1, the truss-like beam 10 is formed of an upper wood chord 11 and a lower wood chord 12. The chords are preferably formed of readily available wood strips, such as common 2×4's or other similar available wood strips. The chords are interconnected by W-shaped web units 14. The units are made up of pairs of struts 15 and 16 which are integrally connected together by means of integral upper and lower common connector plates 17 and 18. The free ends of the outer struts are provided with end connector plates 19.

The upper and lower chords are formed out of wood strips, such as common 2×4's, of sufficient length, or spliced to sufficient length as is commonly known. The chords are preferably rectangular in cross-section and the actual cross-sectional sizes may vary in order to make up the desired beam height. By way of example, if the chords are 2×4's, set on narrow end, the space between them is the same as the height of the chords. Thus, the web unit 14 is sized to span the space between the chords so that one overall unit may be theoretically twelve inches in height, but actually more near ten inches in height because of the differences in actual lumber size as against indicated size. By varying the cross-section size of the chords, or positioning their greater size horizontally, the beam height may be varied.

The web units 14 are formed of sheet metal, such as sheet steel of suitable thickness for the design load purposes. Preferably, the sheet metal is 18 or 20 gauge material. The web units may be made either in the W-shaped configuration as illustrated, or in V-shaped configurations, i.e., as separate V-shapes, or even as individual struts with upper and lower connector plate portions integral therewith. The connector plate portions, in any case, are flat sheet metal, plate-like configurations.

The connector plates are arranged to overlap vertical walls or faces of the chords 11 and 12. Punch-outs or strike-outs 20 are formed in the connector plates to provide struck-out teeth 21 at the opposite ends of the strike-outs. Thus, a pair of teeth may be formed in each strike-out or a single tooth may be formed, as is conventional. The particular shape and arrangement of the teeth may be selected from among those conventionally available; for example, one form of teeth which can be used is shown in my earlier U.S. Pat. No. 4,078,352.

Each of the struts 15 and 16 is formed of a channel 25 having a base 26 and legs 27. As illustrated in FIGS. 4 and 6, the channel gradually narrows in width from bottom end to upper end. The base 26 of each channel is deeply curved at the lower end of the strut or channel, as illustrated in FIG. 10, and the curvature gradually decreases, as illustrated in FIGS. 9 and 8, going upwardly along the length of the channel until it becomes substantially flat at the upper end of the channel as illustrated in FIG. 7. The bow or curve may be roughly a segment of a circle whose radius increases from the bottom to the top of the channel.

The channel legs 27 increase in depth or height from the base of the channel going from the bottom toward the upper end of the channel, as illustrated in FIGS. 10 thru 7. Thus, each of the channels is wider, has a more deeply curved base, and has less deep legs at the lower end of the channel, with the reverse being true at the upper end of the channel. This channel configuration substantially shifts the neutral axis of each of the struts inwardly, reducing the sidewise force component which otherwise tends to push the connector plate teeth outwardly of the wood. Consequently, the beam is capable of sustaining considerably greater loads than would be the case if the channels were of uniform cross section throughout their lengths.

Also, the shifting of the neutral axis of the struts inwardly allows the web units to be utilized with beams having an upper chord of greater width than the lower chord. With such a beam structure, the struts would be angled outwardly from their lower ends to their upper ends and any force applied to the beam would have a tendency to push out the teeth of the upper connector plate in other web units, particularly those nearest the bottom of the upper chord. The present invention, however, shifts the strut neutral axis inwardly and the resultant beam loading force tending to push the lower teeth outwardly is significantly reduced.

An end portion of each of the channel legs 27 is extended to overlap the wood chord along the free edge of its connector plate. Thus, leg extension 28 formed on connector plates 17 and 18 is arranged to overlap and embed into the adjacent face portion of the chord 12. (This is best shown in FIGS. 4 and 6.) Likewise, leg extension 29 formed along the free edge of the end connector plate 19 is arranged to overlap and embed into the upper chord 11. The embedded leg extension portions 28 and 29 are adjacent or alongside the first or inner-most tooth 21a at the respective connector plate free edge. Thus, the leg extension serves to carry some of the load which would otherwise apply to the first tooth and consequently, reduce the load on such tooth. In practice, the first tooth, which is designated 21a for illustration purposes in FIGS. 6 and 13, tends to carry a greater load and thus tends to release from the wood chord sooner, than the other teeth. The leg extension portions changes this by providing an anti-slip or slip resistent connection between the strut and chord at the vulnerable first tooth, i.e., the one nearest to the strut. This permits an increase in loading upon the beam without danger of the first or inner tooth 21a releasing.

Each of the connector plate portions 17 and 18 is provided with a flat strip-like integral extension 30 which extends inwardly of the space between the chords. A similar extension 32 is formed on each of the end connector plates 19. These extensions help to resist the tendency for the plates to twist out of vertical and, consequently, cause tooth pull-out from the chords, due to torgue-like forces upon the plates. Hence, the strength of the fabricated truss-beam is increased.

Although a beam or joist may be formed utilizing only web units comprising groups of struts or separate struts of the type described above, the beam may also be formed of a composite metal web units and wood filler blocks, such as end filler blocks 40 and center filler block 41 illustrated in FIGS. 1 and 2. These filler blocks or strips, which may be formed of scrap lumber of the same size and shape as the chord lumber, span and fill the space between the chords. The blocks or strips are suitably fastened in place between the chords, in tight, face to face contact therewith, by means of mechanical fasteners, such as conventional sheet metal staples 42. For increased strength, the sheet metal plate-like staples may be angled at an acute angle, from bottom towards top, towards their nearest beam end. The staples on the opposite side of the center line or load center 43 of the beam may be oppositely angled. This staple arrangement is described in more detail in my co-pending application, U.S. Ser. No. 113,370 filed Jan. 18, 1980, entitled "Composite Wood Beam and Method of Making Same", filed contemporaneously herewith.

The illustration in FIG. 1 shows the beam fabricated of two W-shaped units 14 separated by a central wood block 41, along with two end wood blocks 40. However, where greater length beams are required, additional W-shaped or V-shaped units may be utilized. For example, two W-shaped units can be used at each side of the beam and the blocks may be of sufficient length to provide the additional beam length required. For fine adjustment of the length of the beams, particularly during assembly on a building, the carpenter may cut end portions off the beam. These end portions which are formed of a lamination of the chords and end blocks or strips, act as if they were a single wood unit which may be cut to provide the necessary length.

When the beam or joist is being assembled, the chords 11 and 12 are laid side by side and spaced apart, the web units 14 are arranged in position above and below the chords, and pressure is applied to embed the connector plate teeth into the chords. When two W-shaped or V-shaped units are placed side by side for the assembly of a long beam, the end connector plates 19 of each unit are abutted together and, when assembled, act in combination substantially the same as unitary connector plates 17 and 18. (For this reason, end connector plates 19 are preferably approximately one-half the width of connector plates 17 and 18.) When filler blocks 40 and 41 are provided for a composite beam, the blocks are placed and stapled in position between chords 11 and 12 before the web units are positioned on and embedded in place.

Having fully described an operative embodiment of this invention, I now claim:

1. In a sheet metal web unit for interconnecting a pair of horizontally elongated, vertically spaced-apart wood chords, with said web unit having at least one strut and at least two flat connector portions, with said strut being channel shaped in cross-section and said connector portions integrally formed on its opposite ends for overlapping and fastening to vertical face portions of the respective wood chords by means of struck-out teeth formed on said connector portions, and with the legs which form such channel shape being arranged to extend from the channel base into the space between the chords, the improvement comprising the channel base gradually narrowing in width in the direction from the bottom end of said strut to the upper end of said strut, said channel base being bowed in cross-section at the lower end of said strut and substantially flat at the upper end of said strut, and the channel gradually flattening out from its lower end toward its upper end, and;

said legs forming the channel gradually increasing in cross-sectional length, that is, in the depth of the channel, from the lower end toward the upper end of said strut.

2. A sheet metal web unit for interconnecting a pair of vertically spaced-apart, elongated wood chords, with the web unit having a strut which is channel shaped in cross-section and having flat connector plates integrally formed on its opposite ends for overlapping and fastening to vertical face portions of the respective wood chords by means of at least one row of struck-out teeth formed on each of said plates for embedding the overlapped chord face portions, and with the legs forming the strut channel arranged for fitting within the space between the channel, the improvement comprising an end portion of at least one of the channel legs, at one of the strut ends, being extended for a short distance along the nearest edge of the connector plate which is integral with said strut end, to thereby overlap and embed into the chord face portion adjacent to said connector plate at least as far as the bottom of the row of struck-out teeth closest to the opposite connector plate and alongside the struck-out tooth which is nearest to said one strut end, for thereby reducing the load carried by said tooth.

3. A web unit as defined in claim 2 wherein said channel base gradually narrows in width in the direction from the bottom end of said strut to the upper end of said strut.

4. In a sheet metal web unit for interconnecting a pair of spaced-apart, elongated wood chords, and including at least one pair of struts which are integrally formed together by a common, flat connector plate adapted to overlap a portion of a chord and having struck-out teeth for embedding in the overlapped chord portion, the improvement comprising the edge of the connector plate which is nearest to the opposite chord being extended into the space between the chords to form a narrow, flat, extension portion which is integral and co-planar with the flat connector plate and extends between the adjacent strut ends, said struts being channel-shaped in cross-section, each said strut channel including a base and opposed flanges, said flanges terminating short of the flat extension portion.

5. The invention as defined in claim 4 wherein said channel base gradually narrows in width in the direction from the bottom end of said strut to the upper end of said strut.

6. A web unit as defined in claims 3 or 5 wherein said channel base is bowed in cross-section at the lower end of said strut and is substantially flat at the upper end of said strut, and the channel gradually flattens out from its lower end toward its upper end.

7. A web unit as defined in claims 1 or 2 or 4, wherein said channel base is bowed along a curve which is roughly a segment of a circle, and with the radii of the cross sectional curvature gradually increasing along the length of the strut, from the strut lower end toward the strut upper end, so that the channel base gradually flattens.

8. A web unit as defined in claims 2 or 4 wherein said legs forming the channel gradually increasing in cross-sectional length, that is, in depth of the channel, from the lower end towards the upper end of said strut.

9. A web unit as defined in claims 1 or 4 wherein an end portion of one of the channel legs is arranged to overlap and embed within an adjacent overlapped wood chord portion alongside of the struck-out tooth nearest to that leg end portion for forming a slip resistant connection with the wood chord portion and reducing the load carried by said tooth, for thereby increasing the resistance to forces which tend to pull said tooth loose from the chord.

10. A web unit as defined in claims 1 or 2 wherein at least one of said connector portions has an integral, coplanar, flat narrow, strip-like extension arranged to extend into the space between the chords.

11. A web unit as defined in claims 1 or 2 or 4 wherein said web unit has two struts arranged at an angle relative to each other and integral with one of said connector portions to form a generally V-shaped configuration.

12. A web unit as defined in claim 11 wherein said strip-like extension extends between the "V" formed by the struts.

13. A web unit as defined in claims 1 or 2 or 4 wherein said web unit has four struts integrally connected together with three common connector portions to form a generally W-shaped configuration.

14. A composite beam formed of a pair of horizontally elongated wood chords which are spaced vertically apart, one above the other, and with each having substantially vertical faces, with sheet metal web units on opposite sides of the chords having struts angled relative to the length direction of the chords, and with the opposite ends of each strut being extended into an enlarged, substantially flat, connector plate arranged in face to face engagement with an adjacent portion of said chord vertical faces, and said plates having struck-out teeth for embedding into adjacent chord portions, and said struts, between the chords, being formed of generally U-shaped in cross-section channels, with the legs of the channels extending from the channel base, being between the chords and substantially the entire distance along the length of their struts between the chords, and the channels on one side of the chords opening towards the channels on the opposite side of the chords, the improvement comprising: each of the channel bases gradually narrowing in width in the direction from the bottom end of said struts to the upper end of said struts said channel bases each being curved in cross-section at the lower end of each of said struts and substantially flat at the upper end of each of said struts, and each of said channels gradually flattening out from their respective lower ends toward their respective upper ends; and the legs of each channel gradually increasing in depth from the bottom to the top of each said strut along the length thereof.

15. A composite beam as defined in claim 14 wherein the end portion of each of said strut channel legs nearest to the connector plate is arranged to extend to overlap and embed within its adjacent chord portion alongside of the struck-out tooth nearest that leg end portion for thereby forming a slip-resistant interconnection between the strut and chord and and reducing the load carried by said tooth.

16. A composite beam as defined in claim 14 wherein said struts are arranged in integrally connected pairs, that is, joined together by a common integral connector plate to form an integral, generally V-shaped arrangement and said connector plates having inner edge portions, i.e., the edges nearest to the space between the chords, being inwardly extended into said space to form a flat strip integral and co-planar with its connector plate and extending between the adjacent strut leg ends.

17. A web unit as defined in claim 14 wherein said web unit has four struts integrally connected together with three common connector portions to form a generally W-shaped configuration.

18. A sheet metal web unit for interconnecting a pair of horizontally elongated, vertically spaced-apart wood chords, with said web unit having a strut which is channel-shaped in cross-section and having flat connector plates integrally formed on its opposite ends for overlapping and fastening to portions of said wood chords by means of struck-out teeth formed on said plates, and with the legs of the strut which form said channel shape being arranged to extend from the channel base into the space between the chords, and with such legs gradually increasing in depth, relative to the channel base, from the lower end towards the upper end of the strut, the improvement comprising the channel base being relatively deeply curved in cross-section at the lower end of the strut and the cross sectional curvature of the base gradually decreasing from the lower end to the upper end of the strut until it is substantially flat near the upper end of the strut, said channel gradually decreasing in width from the lower end of the strut toward the upper end of the strut.

19. A web unit as defined in claim 18 wherein an end portion of one of the channel legs is arranged to overlap and embed within an adjacent overlapped wood chord portion alongside of the struck-out tooth nearest to that leg end portion for thereby forming a slip resistant connection with the wood chord portion to reduce the load on said tooth.

* * * * *